US006138281A

United States Patent [19]

Chiaruttini

[11] Patent Number: 6,138,281

[45] Date of Patent: Oct. 31, 2000

[54] SOCK WITH IMPROVED COMFORT

[75] Inventor: Claudio Chiaruttini, Botticino, Italy

[73] Assignee: Vegas Spa, Rezzato, Italy

[21] Appl. No.: 09/340,320

[22] Filed: Jun. 25, 1999

[30] Foreign Application Priority Data

Jun. 26, 1998 [IT] Italy ..... MI980452 U

[51] Int. Cl.[7] ..... A41B 11/00

[52] U.S. Cl. ..... 2/239

[58] Field of Search ..... 2/239, 240, 241, 2/242; 36/43, 10; D02/896

[56] References Cited

U.S. PATENT DOCUMENTS

| | | | |
|---|---|---|---|
| 74,912 | 2/1868 | Hadley | 2/239 |
| 1,436,439 | 11/1922 | Eichhorn | 36/44 |
| 4,069,515 | 1/1978 | Swallow et al. | 2/239 |
| 4,149,274 | 4/1979 | Garrou et al. | 2/239 |
| 4,651,354 | 3/1987 | Petrey | 2/239 |
| 4,694,831 | 9/1987 | Seltzer | 128/582 |
| 4,760,655 | 8/1988 | Mauch | 36/44 |
| 4,907,350 | 3/1990 | Chilewich et al. | 36/19 R |
| 5,007,111 | 4/1991 | Adams | 2/22 |
| 5,329,640 | 7/1994 | Hourigan | 2/239 |
| 5,553,398 | 9/1996 | Schnewlin-Maier | 36/43 |
| 5,617,585 | 4/1997 | Fons et al. | 2/239 |
| 5,664,342 | 9/1997 | Buchsenschuss | 36/43 |
| 5,685,094 | 11/1997 | Lin | 36/141 |
| 5,787,509 | 8/1998 | Alvera | 2/241 |
| 5,791,163 | 8/1998 | Throneburg | 66/178 R |
| 5,894,687 | 4/1999 | Lin | 36/141 |
| 5,896,680 | 4/1999 | Kim et al. | 36/28 |

*Primary Examiner*—John J. Calvert
*Assistant Examiner*—Alissa L. Hoey
*Attorney, Agent, or Firm*—Herbert Dubno

[57] ABSTRACT

A sock with improved comfort includes a stocking sole (2) having a plurality of resilient projections (3) on at least one of its surfaces for protecting and cure the foot of the user.

8 Claims, 2 Drawing Sheets

SOCK WITH IMPROVED COMFORT

FIELD OF THE INVENTION

The present invention relates to a sock or stocking with improved comfort.

BACKGROUND OF THE INVENTION

It is known that the long tendons of the flexing muscles, the nerves and blood vessels and the muscles of the foot are in the area of the plantar arch.

The dermis of the foot is considerably thicker in the plantar arch region while the epidermis in this area operates as a cushion for the bones that in this manner do not rest directly on the vessels or the skin while the person is standing or walking.

In view of this complex osteo-articulation structure, during sport practice, work, or even during normal daily activities, the foot is subjected to considerable stress which may cause damage to the foot.

For the above reason, socks have been proposed which, according to the use or requirements of the user, have a differentiated knitting structure in order to reduce the stress on the osteo-articulation structure of the foot.

The above type of socks have a thicker knitting in order to provide a sort of cushion or padding in various areas of the sock for damping the impacts against the osteo-articulation structure of the foot, especially during sport practice.

However, the above described socks do not solve the very important problem of the blood circulation in the foot and the associated problems.

In some cases those types of socks, which are designed for a short use during the sport practice, may even negatively affect the blood circulation in the foot.

OBJECTS OF THE INVENTION

The aim of the present invention is to eliminate the above described drawbacks of the prior art socks.

An object of the invention is to provide a sock with improved comfort which offers an effective protection to the osteo-articulation structure of the foot and at the same time improves the blood circulation in the foot.

A further object of the invention is to provide a sock with improved comfort which allows the foot to breathe thus eliminating the problems associated with poor transpiration of the foot.

A further object of the invention is to provide a sock with improved comfort which also operates as a damper thus preserving the osteo-articulation structure of the foot.

A further object of the invention is to provide a sock with improved comfort which, when using "Teflon" inserts in the sock, therefore in socks that slide freely on the resting base, nevertheless provide a sufficient adherence in areas that do not negatively affect such feature.

Still a further object of the invention is to provide a sock with improved comfort having a reduced cost which substantially does not affect the retail price of the sock with respect of traditional socks.

SUMMARY OF THE INVENTION

The above aims and other aims that will be more apparent hereinafter, are achieved by a sock with improved comfort comprising a stocking sole having a plurality of resilient projections on at least one of its surfaces for protecting and treating the foot of the user.

Further characteristics and advantages of the invention will be more apparent by the following description of an embodiment of the invention, illustrated, by way of example in the enclosed drawings.

BRIEF DESCRIPTION OF THE DRAWING

The above and other objects, features, and advantages will become more readily apparent from the following description, reference being made to the accompanying drawing in which.

DESCRIPTION OF THE PREFERRED EMBODIMENTS OF THE INVENTION

Figure 1:
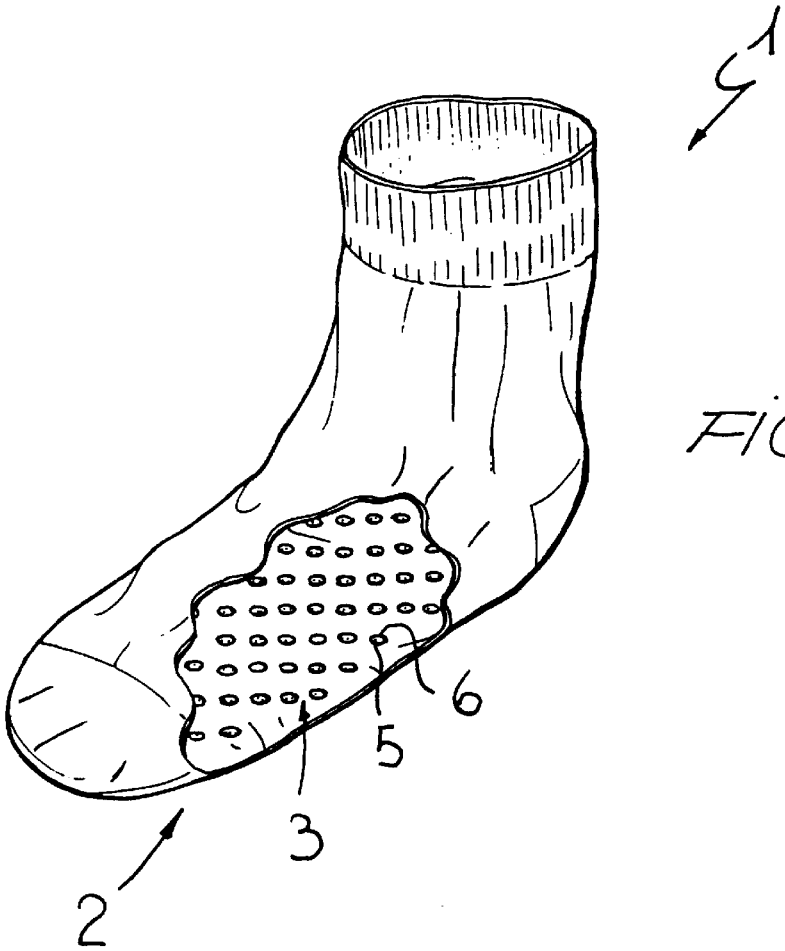
FIG. 1 is a partial section side perspective view of the sock according to the invention.

With reference to the above figures, the sock with improved comfort, according to the invention, globally designated by the reference numeral 1, comprises a stocking sole 2 having a plurality of projections 3 on at least one of its surfaces. Each projection 3 is resilient and elastically yields to allow the protection and cure of the foot 4 of the user.

In particular, projections 3 may be disposed on any surface of the stocking sole 2 and particularly on the surface in contact with the foot sole.

Figure 6:
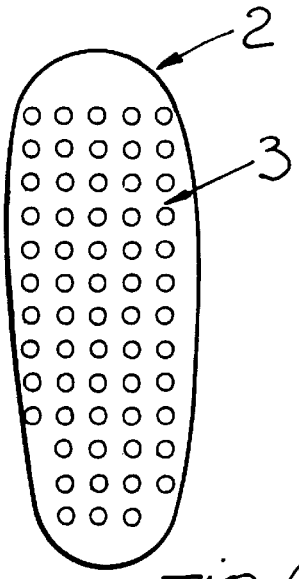
FIGS. 6 to 8 are top plan views showing the different distribution of the projections on a surface of the sock according to the invention.
Figure 7:
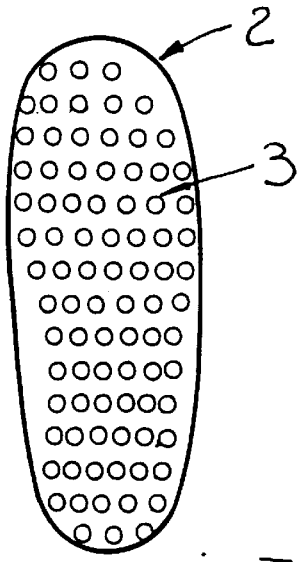
Figure 8:
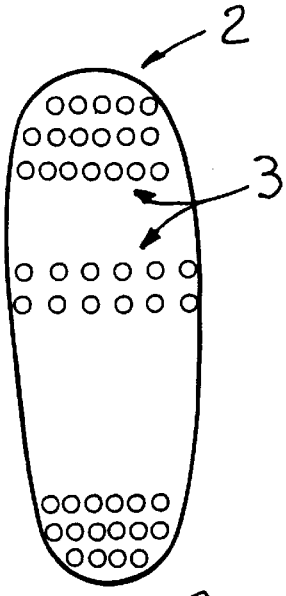

The projections may be arranged uniformly on such surface, as for example shown in FIG. 6, or alternatively may be arranged with variable density on different areas according to the user's requirements, as for example shown in FIG. 8, or according to the shape of the foot sole, as shown in FIG. 7.

Each projection 3 comprises a base 5 fixed to the sock fabric, particularly to the stocking sole 2, and an extension 6 extends from the base 5 towards the foot sole.

The extension 6 may be variable in height according to the location of the projection 3 on the stocking sole surface and according to the type of massage required by the user and other requirements.

The base 5 is made of rubber and is sufficiently stiff to be seamed to the fabric of the stocking sole and at the same time to prevent the extension 6, which is made of softer rubber, from collapsing.

In this manner the base 5 allows the extension 6 to extend outside the fabric of the stocking sole thus effectively massaging the foot sole.

For the same purpose, both the base 5 and the extension 6 are round, or circular, in shape in order to better perform the damping and massaging actions without any pointed part that could possibly abrade the foot.

It is evident that by varying the height and the stiffness of the projection 6 it is possible to vary the damping action on various areas of the foot sole according to the requirements of the user and to the specific sport activities.

When the sock has Teflon (polytetrafluoroethylene) thread inserts 11, adapted to improve the sliding of the sock on a surface, such as the shoe sole, projections 3 may extend towards the opposite side of the foot in some of the areas affected by the Teflon inserts, in order to prevent any interference with the sliding properties of the sock and at the same time in order to provide a better adherence to a surface, for example during walking.

Figure 2:
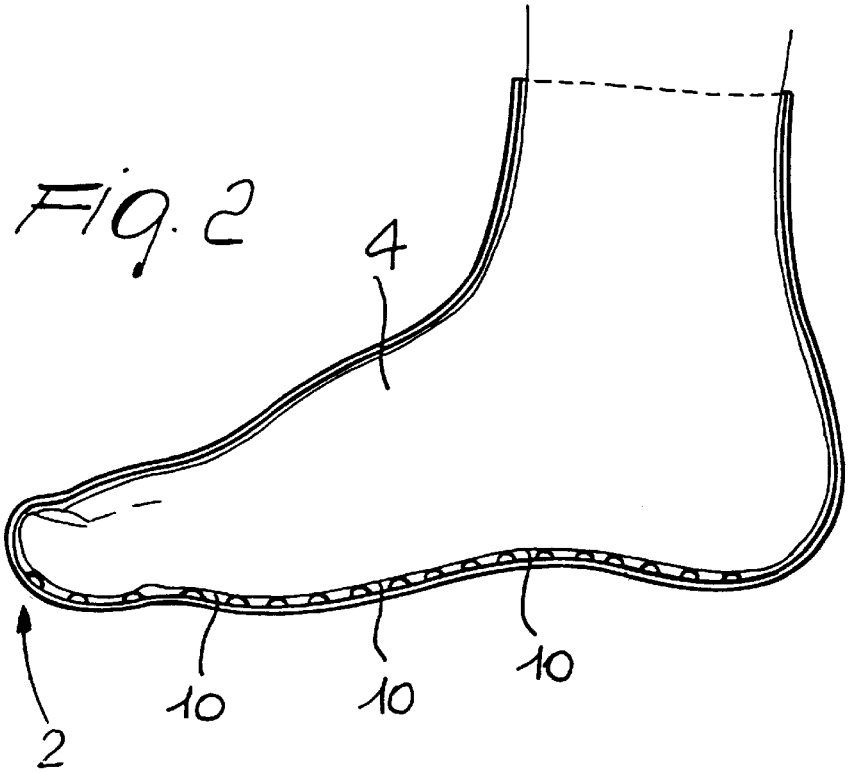
FIG. 2 is a schematic section view of the sock according to the invention.
Figure 3:
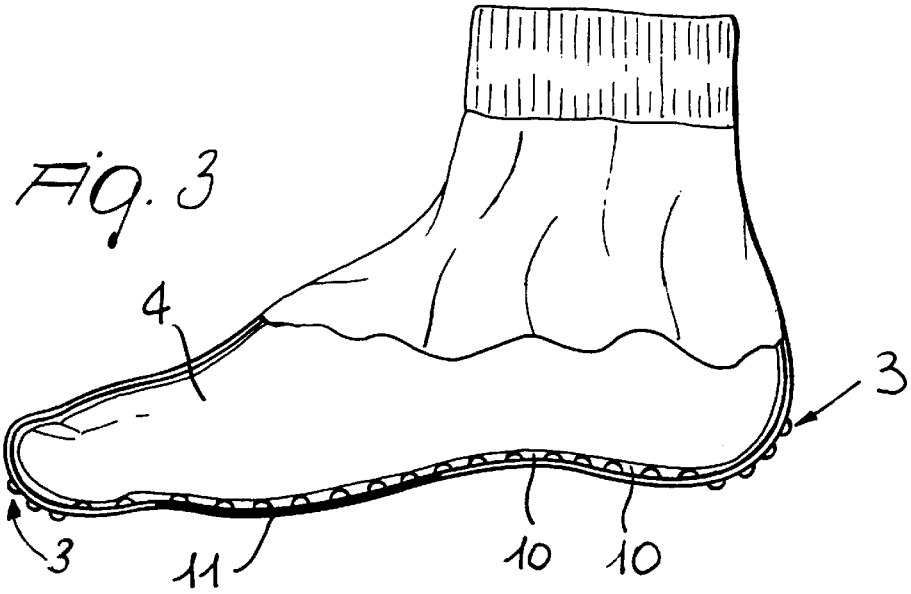
FIG. 3 is a schematic section view of the sock showing how the projections may extend towards the foot or towards the opposite side in some areas of the sock.
Figure 4:
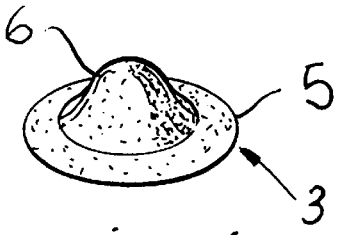
FIG. 4 is an enlarged perspective view of the sock according to the invention.
Figure 5:
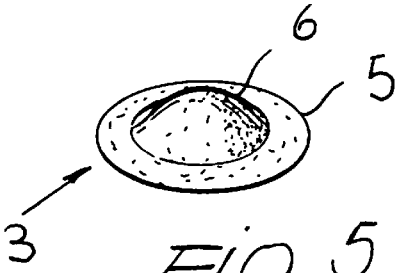
FIG. 5 shows a projection of FIG. 3 having a lower height according to the requirements.

As shown in FIG. 2, when the sock is worn by the user, a plurality of channels 10 form between the foot sole and the sock fabric, i.e. the foot rest area, thus allowing a better transpiration of the foot.

It is apparent from the above description that in order to obtain an effective massage of the foot sole and a good transpiration, the user need only to wear the sock as a conventional sock or stocking.

Automatically, when walking or standing, a damping of the shocks against the foot osteo-articulation structure is achieved and a "pumping" of air through the channels 10 as well as a massage that effectively improves the blood circulation in the foot.

The sock with improved comfort according to the invention may have numerous modifications and variations, within the scope of the appended claims. All the details may be substituted with technically equivalent elements.

The materials employed, as well as the dimensions, may be any according to the specific needs and the state of the art.

What is claimed is:

1. A sock with improved comfort comprising a stocking sole having a plurality of resilient projections on at least one surface of said stocking sole for protecting and treating the foot of the user, said projections each comprising a base fixed to the fabric of said stocking sole and an extension extending from said base and directed toward the foot of the user.

2. The sock, according to claim 1 wherein said projections are uniformly arranged on said surface.

3. The sock, according to claim 1 wherein said projections are arranged on said surface with a variable density.

4. The sock, according to claim 1 wherein said bases are made of a rubber having a stiffness greater than the stiffness of said extension.

5. The sock, according to claim 1 wherein said base and said extensions are substantially circular in shape.

6. The sock, according to claim 1 wherein said extensions are variable in height according to the position of said projection on said surface.

7. The sock, according to claim 1 wherein said projections are arranged on said surface with a configuration substantially imitating the foot sole.

8. The sock according to claim 1 comprising at least one area provided with a polytetrafluoroethylene thread on a side of said stocking sole turned away from the foot of the user.

* * * * *